US006645705B2

(12) United States Patent
Yau et al.

(10) Patent No.: US 6,645,705 B2
(45) Date of Patent: Nov. 11, 2003

(54) PROTECTIVE OVERCOAT FOR PHOTOGRAPHIC ELEMENTS

(75) Inventors: Hwei-Ling Yau, Rochester, NY (US); Kevin M. O'Connor, Webster, NY (US); Elmer C. Flood, Canandaigua, NY (US); David E. Decker, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/007,359

(22) Filed: Nov. 5, 2001

(65) Prior Publication Data

US 2003/0162138 A1 Aug. 28, 2003

(51) Int. Cl.[7] ..... G03C 1/76; G03C 11/06; G03C 5/29; G03C 5/26; G03C 11/16

(52) U.S. Cl. ..... 430/350; 430/432; 430/434; 430/531; 430/533; 430/536; 430/537; 430/961

(58) Field of Search ..... 430/350, 531, 430/533, 536, 537, 961, 432, 434

(56) References Cited

U.S. PATENT DOCUMENTS

| | | | | |
|---|---|---|---|---|
| 5,856,051 A | | 1/1999 | Yau et al. | 430/536 |
| 6,194,130 B1 | | 2/2001 | Nair et al. | 430/536 |
| 6,232,049 B1 | * | 5/2001 | Nair et al. | 430/531 |
| 6,319,658 B1 | * | 11/2001 | Lobo et al. | 430/531 |
| 6,426,167 B2 | * | 7/2002 | Yau et al. | 430/537 |
| 6,436,617 B1 | * | 8/2002 | Wang et al. | 430/536 |
| 6,479,222 B1 | * | 11/2002 | Jones et al. | 430/350 |

FOREIGN PATENT DOCUMENTS

| | | |
|---|---|---|
| EP | 0 915 371 A1 | 10/1998 |
| WO | WO 80/02333 | 4/1979 |

OTHER PUBLICATIONS

Author: Molecular Probes, Title: Pluronic ® F–127, Date: Revised May 3, 1999, p. 2.

* cited by examiner

*Primary Examiner*—Richard L. Schilling
(74) *Attorney, Agent, or Firm*—Chris P. Konkol

(57) ABSTRACT

The present invention is a photographic element which includes a support, at least one silver-halide emulsion layer superposed on the support and a processing-solution-permeable overcoat overlying the silver-halide emulsion layer that becomes water-resistant in the final product, without requiring lamination or fusing. The presence, in the coating composition, of a compound comprising a blocked copolymer of ethylene oxide and propylene oxide has been found to improve wet durability, prevent the retention of iron, and improve the conversion of the overcoat to a water-resistant layer during processing. The present invention is also directed to a method of making a photographic print involving developing the photographic element.

20 Claims, No Drawings

PROTECTIVE OVERCOAT FOR PHOTOGRAPHIC ELEMENTS

FIELD OF THE INVENTION

The present invention relates to photographic imaging elements having a protective overcoat that resists fingerprints and common stains. The invention involves converting a processing-solution-permeable overcoat to a waterresistant overcoat during photochemical processing, which conversion is improved by employing, in the overcoat formulation, a compound comprising a block-copolymer chain of ethylene oxide and propylene oxide.

BACKGROUND OF THE INVENTION

Silver-halide photographic elements contain light-sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver-halide development by one of several different processes. The most common is to allow a by-product of silver-halide development, oxidized silver halide developing agent, to react with a dye-forming compound called a coupler. The silver and the unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin or similar natural or synthetic hydrophilic polymers have proven to be the binders of choice for silver halide photographic elements. Unfortunately, when gelatin or similar polymers are formulated so as to facilitate contact between the silver-halide crystals and aqueous processing solutions, the imaged product is not as fingerprint and stain resistant as would be desirable, particularly in view of the handling or environmental exposure commonly experienced by the pictures. The imaged product can be easily stained by common household products, such as foods or beverages; fingerprints can leave marks.

There have been attempts over the years to provide protective layers for gelatin based photographic systems that will protect the images from damages by water or aqueous solutions.

Various lamination techniques are known and practiced in the trade. U.S. Pat. Nos. 3,397,980, 3,697,277 and 4,999,266 describe methods of laminating a polymeric sheet film, as a protective layer, on a processed image. U.S. Pat. No. 5,447,832 describes the use of a protective layer containing a mixture of high and low Tg latices as a water-resistant layer to preserve the antistat property of a $V_2O_5$ layer through photographic processing. This protective layer is not applicable to the image formation layers, however, since it will detrimentally inhibit the photographic processing. U.S. Pat. No. 3,443,946 provides a roughened (matte) scratch-protective layer, but not one designed to be water-impermeable or resistant. U.S. Pat. No. 3,502,501 is intended to provide protection against mechanical damage only, the layer in question contains a majority of hydrophilic polymeric materials, and must be permeable to water in order to maintain processibility. U.S. Pat. No. 5,179,147 likewise provides an overcoat that is not water-protective.

Protective coatings that need to be applied to the image after it is formed, several of which were mentioned above, adds a significant cost to the final imaged product. Processing equipment needs to be modified and the personnel running the processing operation need to be trained to apply the protective coating. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a[]photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. Again, however, fusing is required by the photofinishing laboratories to render the protective overcoat water resistant. Similarly, commonly assigned U.S. Ser. No. 09/353,939 and U.S. Pat. No. 6,268,101, respectively, describe the use of a polystyrene-based material and a polyurethane-based material, with gelatin as the binder, in an overcoat for a photographic element, which overcoat can be fused into a water resistant overcoat after photographic processing is accomplished to generate an image.

Several methods were patented based on the concept of an overcoat composition comprising of a hydrophilic material and a hydrophobic material. The washing out of the hydrophilic component facilitates the coalescence of the hydrophobic materials in the final product, further facilitated by elevated temperatures commonly associated with drying. Various hydrophilic materials, such as non-crosslinked gelatin or polyvinylalcohol, and various hydrophobic materials, such as polyurethanes and epoxy resins, have been disclosed, for example in commonly assigned U.S. Pat. No. 6,232,049, U.S. Pat. No. 6,194,130, and U.S. Ser. No. 09/699,866.

PROBLEM TO BE SOLVED BY THE INVENTION

It has been found that imaged elements having overcoats in which a hydrophilic material is washed out during processing can suffer from the problem of wet abrasion or wet scratch when they are brought into contact with any face-side rollers in the processor or in the dryer. The hydrophilic material is washed out preliminary to conversion of the overcoat from a processing-solution permeable overcoat to a water-resistant protective overcoat. Without wishing to be bound by theory, it is believed that the overcoat may form a porous membrane, lacking physical strength and integrity, during removal of the hydrophilic material or polymer during processing. It was also noticed that some hydrophobic particles used in the overcoat can retain iron from bleach solution, resulting in a yellowish color stained image. Finally, incomplete conversion to a water-resistant protective overcoat was found to occur with some hydrophobic materials.

Therefore, it would be desirable to provide a novel overcoat that is permeable to photo-processing solution for image formation, and yet which is capable of converting to a protective overcoat for stain and fingerprint resistance. It is desirable that the process of converting such novel overcoat from water-permeable to water-resistant be economical without the additional step of laminating or high temperature fusing. It is most preferable that the process be compatible to current photo-processing equipment without any modification. It would also be desirable for such an overcoat, during processing, to be robust without leaving any roller marks or scratch marks on the imaged product from photoprocessing. It would also be desirable for the overcoat not to retain photoprocessing chemicals that can lead to a stained image.

SUMMARY OF THE INVENTION

The present invention is directed to a processing-solution-permeable overcoat for a photographic element that provides water resistance in the final product. For example, such a photographic element may comprise a support, at least one silver-halide emulsion layer superposed on the support, and overlying the silver-halide emulsion layer, a processing-solution-permeable protective overcoat composition that can be incorporated into or coated on the imaging element during manufacturing and that does not inhibit photographic processing.

A first component of the coating composition of the present invention is a hydrophobic material in the form of hydrophobic polymer particles that are water-dispersible, which can be introduced into the overcoat coating solution in a latex form or as a conventional colloidal dispersion in a hydrophilic binder. A second component of the coating composition is a hydrophilic polymer. A third component of the coating composition is a compound comprising a blocked copolymer of ethylene oxide and propylene oxide (PEO-b-PPO). The presence of both a hydrophilic polymer and a block copolymer of PEO-b-PPO allows photographic processing to proceed at an acceptable rate. The washing out of these two components by photo-processing facilitates the coalescence of the hydrophobic material in the final product, further facilitated by elevated temperatures commonly associated with drying.

Another aspect of the invention provides for a method of forming an image in the imaging element described above and converting the overcoat into a water-resistant coating.

One advantage of an overcoat composition according to the present invention is a reduction in the scratch propensity when the emulsion side of the imaged element is brought in contact with rollers during photoprocessing. Another advantage is a reduction in the retention, by the overcoat, of photoprocessing chemicals. Yet another advantage is that the invention aids in the complete conversion, during processing, of the process-solution-permeable overcoat to a water-resistant overcoat.

DESCRIPTION OF THE PREFERRED EMBODIMENTS

The present invention provides a simple and inexpensive way to improve the water, stain and abrasion resistance of processed photographic elements. In accordance with the invention, the protective overcoat is applied over the photographic element prior to exposure and processing. In particular, an overcoat formulation according to the present invention is applied to the emulsion side of photographic products, particularly photographic prints, which may encounter frequent handling and abuse by end users.

By the term "water-resistant" is meant herein after ordinary photoprocessing and drying does not imbibe water or prevents or minimizes water-based stains from discoloring the imaged side of the photographic element.

By the term "elevated temperature", as used in this application, to dry and/or facilitate coalescence of the water-dispersible polymer, is herein meant a temperature of from 30 to 80° C., preferably 45 to 60° C. In contrast, fusing typically requires a pressure roller or belt and drying of the imaged element before fusing. Fusing generally requires higher temperatures, typically above the boiling point of water, usually above 100° C.

The present invention provides an improved overcoat formulation for the imaging side of an imaging element or material, including photographic prints, which encounter frequent handling and abuse by end users. The preferred overcoat formulation of this invention comprises 30 to 95% by weight of solids of water-dispersible polymer particle having an average particle size of less than 500 nm and a $T_g$ between −40° C. and 80° C., 4.5 to 69.5% by weight of solids of water-soluble hydrophilic polymer, and 0.5 to 15% by weight of solids of block copolymer of ethylene oxide and propylene oxide (based on the dry laydown of the overcoat).

In one embodiment, a water-resistant layer is facilitated by coalescing the residual water-dispersible polymer material in the imaging element at a temperature sufficiently high, preferably during the drying step, after the photographic material has been photochemically processed. It is noted that some gelatin from underlying layers in the photographic element may migrate into the overcoat, during manufacture or photochemical processing, for example, but any such migration is limited and, by definition, is not included in the composition formulation.

As indicated above, a photographic element according to the present invention comprises: (a) a support; (b) at least one silver-halide emulsion layer superposed on a side of said support; and (c) overlying the silver emulsion layer, a processing-solution-permeable protective overcoat having a laydown of at least 0.54 $g/m^2$(50 $mg/ft^2$) made from a formulation comprising 30 to 95% by weight of solids, preferably 60 to 90 weight percent, of water-dispersible polymer particles having an average particle size of less than 500 nm and a $T_g$ between −40 to 80° C., preferably 10° C. to 75° C., 4.5 to 69.5% by weight of solids, preferably 10 to 40 weight percent, of a water-soluble hydrophilic polymer, and 0.5 to 20% by weight of solids, preferably 1% to 15% of a compound comprising a block copolymer of ethylene oxide and propylene oxide, wherein the hydrophilic polymer and the block copolymer PEO-b-PPO are substantially washed out of the overcoat, leading to the formation of a water-resistant overcoat after photoprocessing without fusing, namely by maintaining the photographic element at temperature less than 100° C.

The dispersions of hydrophobic polymers used in this invention are latexes or hydrophobic polymers of any composition that can be stabilized in a water-based medium. Such hydrophobic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, epoxy compounds, vinyl heterocyclic compounds, styrenes, olefins and halogenated olefins, unsaturated acids and esters derived form them, unsaturated nitriles, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

The water-dispersible polymer is selected so that fusing is not required, a potentially significant advantage compared to the prior art, for example U.S. Pat. No. 5,856,051, mentioned above. It has been found that once the hydrophilic polymer is removed during photographic processing (including optional additional washing), the selected water-dispersible particles will coalesce without fusing (which they would not do in the presence of substantial amounts of crosslinked gelatin or the like).

In a preferred embodiment of the invention, the water-dispersible polymer is a substantially amorphous, thermoplastic polymer having ionic (ionized or ionizable) groups or moieties in sufficient number to provide water dispersibility prior to coating. In addition to water-resistance, the polymer dispersions in the finally processed product preferably provides further advantageous properties such as good chemical and stain resistance, wet-abrasion resistance, fingerprint resistance, toughness, elasticity, durability, and/or resistance to various oils.

In accordance with this invention, the protective overcoat preferably comprises, in addition to the water-dispersible polymer described above, at least one water-soluble hydrophilic polymer. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly(methacrylic acid), poly (oxymethylene), poly(ethyleneimine), poly(ethylene glycol methacrylate), poly(hydroxy-ethyl methacrylate), poly (vinyl methyl ether), poly(styrene sulfonic acid), poly (ethylene sulfonic acid), poly(vinyl phosphoric acid) and poly(maleic acid), copolymers thereof and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions.

The preferred hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis i(or saponification) in the polyvinyl alcohol is preferably at least about 70% or more, more preferably at least about 80%. Percent hydrolysis refers to mole percent. For example, a degree of hydrolysis of 90% refers to polymers in which 90 mol% of all co-polymerized monomer units of the polymer are vinyl alcohol units. The remainder of all monomer units consists of monomer units such as ethylene, vinyl acetate, vinyl trifluoroacetate and other comonomer units which are commonly used to prepare such copolymers. Most preferably, the polyvinyl alcohol has a weight average molecular weight (MW) of less than 150,000, preferably less than 100,000, and a degree of hydrolysis greater than 70%. Combination of more than one type of PVA can be used in the overcoat composition of this invention. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 4.5 and 69.5 weight percent of the water-dispersible polymer, preferably between 5 and 50 weight percent of the water-dispersible polymer, most preferably between 10 and 40 weight percent of the water-dispersible polymer.

In accordance with this invention, the protective overcoat preferably comprises, in addition to the water-dispersible polymer and water-soluble hydrophilic polymer described above, at least one compound that comprises a block copolymer of ethylene oxide and propylene oxide. Such compounds include, not only blocked copolymers based exclusively on ethylene oxide and propylene oxide, but also compounds of which only a portion comprises a poly (oxypropylene)-poly(oxyethylene) blocked polymer with another compound or polymer. One or more poly (oxypropylene)-poly(oxyethylene) block copolymers may be copolymerized with other monomers or may be attached to another species. The compound may comprise an adduct of one or poly(oxypropylene)-poly(oxyethylene) block copolymers with another compound or the reaction product of ethylene oxide and/or prolpylene oxide, to form a blocked copolymer, with another compound. Some examples of preferred types of compounds, including architecture with respect to the block copolymer chains, are shown below. Variations in the architecture are also included in the scope of this invention.

(I)

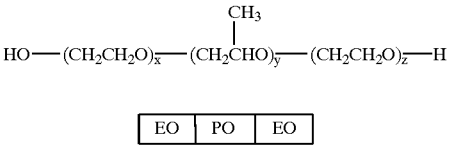

(II)

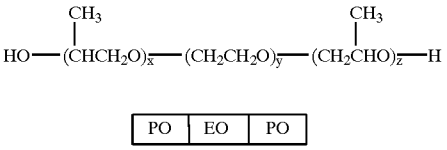

(III)

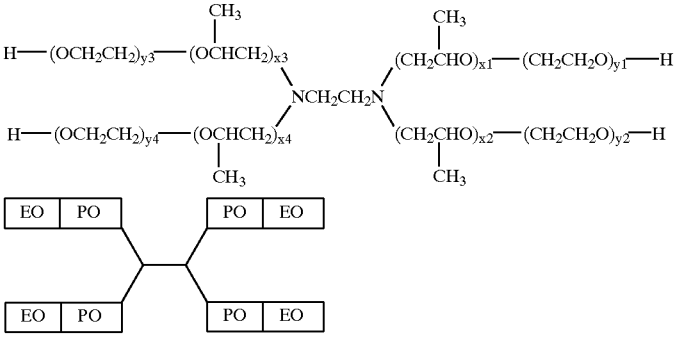

(IV)

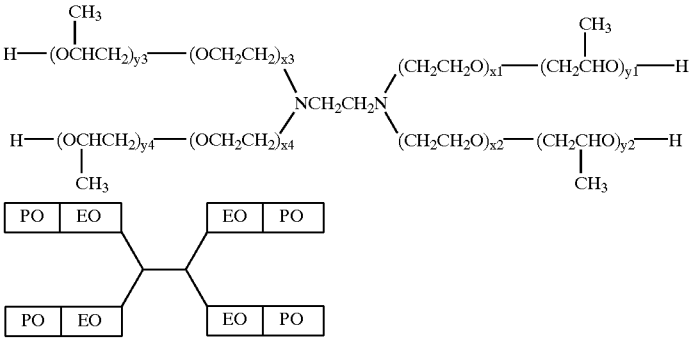

In the above structures (I) to (IV), the various subscripts x, y, z, x1, y1, x2, y2, etc. independently represent the number of the oxyethylene and oxypropylene monomeric units in the formula. Preferably, the relative amounts of the various units (and the various subscript numbers) are selected so that the hydrophilic portion (the oxyethylene portion) in the compound represents at least 40 weight percent with respect to the total amount of both the hydrophilic and hydrophobic portions (respectively, the oxyethylene and oxypropylene portions) in the compound. Preferably the oxyethylene (hydrophilic) monomeric units represent at least 50 percent by weight, most preferably 60 to 90 percent by weight of the total monomeric units in the block-copolymer chain or chains. Preferably the compound is essentially a block copolymer of poly(oxyethylene)-poly (oxypropylene), or an adduct of one or more such block-copolymer chains with another compound such as ethylene diamine. More preferably, the compound comprises greater than 50 weight percent, preferably greater than 80 weight percent of block copolymer poly(oxyethylene)-poly (oxypropylene), in the form of one or more chains, preferably one to four block-copolymer chains of ethylene oxide and propylene oxide.

Suitably, the molecular weight (weight average molecular weight) of the compound is greater than 4000, more preferably greater than 5000, more preferably at least 8,000, preferably less than 100,000, more preferably less than 50,000. The compound is employed in the amount of 0.5 to 20% by weight of solids in the overcoat formulation, preferably 1% to 15% of a compound, more preferably 3% to 10%, which compound comprises a block copolymer (in the form of one or more chains) of ethylene oxide and propylene oxide.

Without wishing to be bound by theory, it is believed that substantial amount of the water-soluble polymer and the PEO-b-PPO-containing compound are removed by photographic processing, resulting in an overcoat that is a substantially water-dispersible polymer, which allows the formation of a water-resistant overcoat that does not require fusing, merely elevated temperatures preferably up to about 60° C. PEO-b-PPO block copolymers are known to be surface-active due to its bi-functional characters of hydrophobicity and hydrophilicity. It is believed that the presence of PEO-b-PPO in a mixture of hydrophobic particles and hydrophilic polymer affects the biphasic morphology, as well as the surface characteristics of the layer, offering several unexpected advantages for the overcoat, including (1) improved wet scratch/scuff resistance in photoprocessing, and (2) minimized iron retention from photoprocessing, while maintaining the conversion from a water permeable to a water resistant overcoat by photoprocessing without a fusing or enhanced drying step. Polyurethane polymers are particularly prone to retained iron. Also, the presence of PEO-b-PPO when employing hydrophobic polymers in the overcoat not containing ionic groups (for example, a copolymer comprising vinylidene chloride, alkyl acrylate, and hydroxyalkyl methacrylate) was found to improve conversion of the overcoat to a water-resistance layer.

Optionally, the coating composition in accordance with the invention may also contain suitable crosslinking agents for crosslinking the water-dispersible polymer. Such an additive can improve $_1$the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

In one preferred embodiment, the water-dispersible polymer of this invention are polyurethanes, preferably segmented polyurethanes. Polyurethanes are the polymerization reaction product of a mixture comprising polyol monomers and polyisocyanate monomers.

A preferred segmented polyurethane is described schematically by the following structure (1):

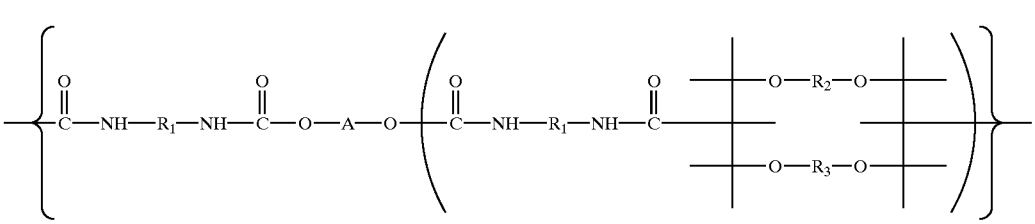

Structure (1)

wherein $R_1$ is preferably a hydrocarbon group having a valence of two, more preferably containing a substituted or unsubstituted, cyclic or non-cyclic, aliphatic or aromatic group, most preferably represented by one or more of the following structures: 9

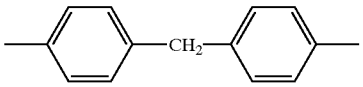

-continued

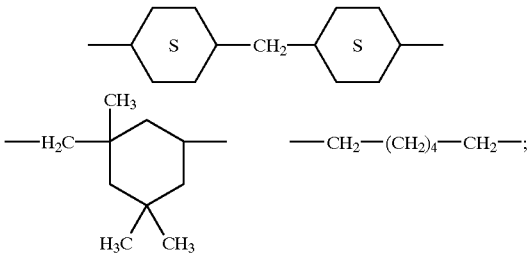

and wherein A represents a polyol, such as a) a dihydroxy polyester obtained by esterification of a dicarboxylic acid such as succinic acid, adipic acid, suberic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of F-caprolactone and; one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_3$ is a phosphonate, carboxylate or sulfonate group; and.

$R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide hydrazides made by reacting lactones with hydrazine such as gamma-hydroxylbutyric hydrazide, bis-semicarbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of Structure I can range from 2 to 200, preferably 20 to 100. The amount of the hard-segment (in the right-hand parenthesis) is preferably 40 to 70 percent by weight. The weight ratio of the $OR_3O$ to the $OR_2O$ repeating unit preferably varies from 0 to 0.1. The water-dispersible polyurethane employed in the invention may be prepared as described in "Polyurethane Handbook," Hanser Publishers, Munich Vienna, 1985.

The term "polyurethane", as used herein, includes branched and unbranched copolymers, as well as IPN and semi-IPNs comprising at least two polymers, at least one of which is a polyurethane. (An IPN is an intimate combination of two or two or more polymers in a network, involving essentially no covalent bonds or grafts between them. Instead, these intimate mixtures of polymers are held together by permanent entanglements produced when at least one of the polymers is synthesized in the presence of the other. Since there is usually molecular interpenetration of the polymers in IPNs, they tend to phase separate less compared to blends. Such interpenetrating polymer network systems and developments are described by L. H. Sperling in "Interpenetrating Polymer Networks and Related Materials," Plenum Press, New York, 1981, in pages 21–56 of "Multicomponent Polymer Materials" ACS Adv. In Chem. No. 211, edited by D. R. Paul and L. H. Sperling, ACS Books, Washington, D.C., 1986, and in pages 423–436 of "Comprehensive Polymer Science", Volume 6, "Polymer Reactions", edited by G. C. Eastmond, A. Ledwith, S. Russo, and P. Sigwalt, Pergamon Press, Elmsford, N.Y., 1989.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. A polyester polyol is preferred for the present invention.

Polyisocyanates useful for making the prepolymer may be aliphatic, aromatic or araliphatic. Examples of suitable polyisocyanates include one or more of the following: toluene diisocyanate,l tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid. In a preferred embodiment, the polyurethane has an acid number equal to or less than 60, Acid number is in general determined by titration and is defined as the number of milligrams of potassium hydroxide (KOH) required to neutralize one gram of polymer.

Suitable basic materials which may be used to neutralize the acid and form anionic groups for water dispersability are, but not limited to potassium hydroxide, sodium hydroxide, lithium hydroxide, tertiary amines include trimethylamine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the prepolyurethane include ethylenediamine, diaminopropane, hexametbylene diamine, hydrazine, aminoethyl ethanolamine and the like.

In another preferred embodiment, the water-dispersible polymers of this invention are vinyl polymers. The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The water-dispersible vinyl polymers can be prepared in aqueous media or solvent media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. The polymers used for this invention can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The preferred method of polymerization is emulsion polymerization in aqueous media and is well described, for example, in F. A. Bovey, Emulsion Polymerization, issued by Interscience Publishers Inc. New York, 1955.

Furthermore, the vinyl polymer is preferred to contain one or more comonomers of structure (2) below at 20% to 100% by weight based on the total monomers.

Structure (2)

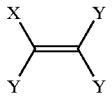

wherein: X is selected from the group consisting of —Cl, —F, or —CN, and Y is each independently selected from the group consisting of H, Cl, F, CN, $CF_3$, $CH_3$, $C_2H_5$, n—$C_3H_7$, iso—$C_3H_7$, n—$C_4H_9$, n—$C_5H_{11}$, n—$C_6H_{13}$, $OCH_3$, $OC_2H_5$, phenyl, $C_6F_5$, $C_6Cl_5$, $CH_2Cl_2$, $CH_2F$, Cl, F, CN, $CF_3$, $C_2F_5$, n—$C_3F_7$, iso—$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

The preferred vinyl monomers of this invention are acrylonitrile, methacrylonitrile, vinylidene chloride, vinylidene fluoride, vinylidene cyanide, vinyl chloride, vinyl fluoride, tetrafluoroethylene, hexafluoropropylene, perfluoropropyl vinyl ether, substituted acrylonitriles including 2-ethylacrylonitrile, 2-n-propylacrylonitrile, 2-isopropylacrylonitirle, 2-n-butylacrylonitrile, 2-n-hexylacrylonitrile, 2-trifluoromethylacrylonitrile, 2-cyanoacrylonitrile, 2-chloroacrylonitirle, 2-bromoacrylonitirle, 2-ethoxyacrylonitrile, cis-3-methoxyacrylonitrile, cis.-3-ethoxyacrylonitrile, 2-acetoxyacrylonitrile, fumaronitrile, maleonitrile. Most preferred monomers are acrylonitrile, vinylidene chloride, and methacrylonitrile.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,326,565; and 1,320,756; and in German Patent Nos. 1,284,295 and 1,284, 294; (3) liquid paraffin and paraffin or wax like materials such as carnauba wax, natural and synthetic waxes, petroleum waxes, mineral waxes, silicone-wax copolymers and the like, (4) perfluoro- or fluoro- or fluorochloro-containing materials, which include poly(tetrafluoroethylene), poly (trifluorocbloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No. 308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion.

The laydown of the overcoat will depend on its field of application. For a photographic element, the laydown of the hydrophobic polymer is suitably at least 0.54 g/m$^2$ (50 mg/ft$^2$), preferably 1.08 to 5.38 g/m$^2$ (100 to 500 mg/ft$^2$), most preferably 1.61 to 3.23 g/m$^2$ (150 to 300 mg/ft$^2$). It may be advantageous to increase the amount of hydrophilic polymer in the overcoat as the laydown increases in order to improve the developability.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying, an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26,1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methlacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, N.Y., 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant, facilitating by wash out of the hydrophilic polymer.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following examples. Unless otherwise indicated, the molecular weights herein are weight average molecular weights, as determined by size exclusion chromotagraphy described below.

EXAMPLES

Characterization of Polymeric Materials

Glass Transition Temperature and Melting Temperature

Both glass transition temperature (Tg) and melting temperature (Tm) of the dry polymer material were determined by differential scanning calorimetry (DSC), using a ramping rate of 20° C./minute. Tg is defined herein as the inflection point of the glass transition and Tm is defined herein as the peak of the melting transition.

Particle Size Measurement

All particles were characterized by Photon Correlation Spectroscopy using a Zetasizer Model DTS5100 manufactured by Malvern Instruments.

Average Molecular Weight

Polymer samples were analyzed by sizeexclusion chromatography in tetrahydrofuran using three Polymer Laboratories Plgel™mixed-C columns. The column set was calibrated with narrow-molecular-weight distribution polystyrene standards between 595 (log M=2.76) and 2170000 (log M=6.34) daltons. The number average ($M_n$) and weight average ($M_w$) were reported. The poly(vinyl alcohol) samples were analyzed by size-exclusion chromatography (SEC) in dimethyl sulfoxide (DMSO) containing 0.01M lithium nitrate using one Jordi Gel GBR mixed-bed column. The column set was calibrated with narrow-molecular-weight distribution pullulan standards between MW 5,900 (log M=3.77) and MW 788,000 (log M=5.90). Results were plotted as pullulan equivalent molecular weights and the number average ($M_n$) and weight average ($M_w$) were reported.

Preparation of Hydrophobic Particles

Hydrophobic Particle P-1

In a 2-liter resin flask equipped with thermometer, stirrer, water condenser and a vacuum outlet was placed 233.92 g (0.272 moles) of polycarbonate polyol PC1733 (Mw=860) (Stahl Co.). It was dewatered under vacuum at 100° C. The vacuum was released and the following were added at 40° C. while stirring: 22.27 g (0.166 moles) dimethylol propionic acid, 41.09 g (0.180 moles) bisphenol-A, 47.76 g (0.530 moles) 1,4-butanediol, 180 g 2-butanone, and 40 drops of dibutyltin dilaurate (catalyst). The temperature was adjusted to 80° C., and when a homogeneous solution was obtained, 226.74 g (1.02 moles) of isophorone diisocyanate was slowly added, followed by 20 g of 2-butanone. The temperature was raised to 85° C. and maintained for about 16 hours to complete the reaction, resulting in an intermediate containing less than 3% free isocyanate.

The free isocyanate content was monitored by Infrared spectroscopy of the absorption peak at 2240 wave number. The reaction mixture was diluted with acetone and neutralized with 19.7 g of 45% potassium hydroxide solution to achieve 95% stoichiometric ionization based on dimethylol propionic acid. 1300 g of distilled water were added to the neutralized mixture under high shear to form a stable aqueous dispersion. 2-Butanone and acetone were removed by heating under vacuum to give an aqueous dispersion at 24.7% solids. Glass transition temperature was 49° C. as measured by DSC, and weight average molecular weight was 24,100.

Hydrophobic Particle P-2

The same preparation scheme as for P1 was used except that polycaprolactone polyol TONE0260 (MW=3000) (Union Carbide) was used in place of PC1733 polycarbonate polyol, and the relative amounts of components were adjusted such that the monomer feed ratio on a weight basis was 33.3% polycaprolactone polyol TONE0260, 4.1% dimethylol propionic acid, 11.4% 1,4-butanediol, 9.9% Bisphenol-A, and 41.3% isophorone diisocyanate. 2-Butanone and acetone were removed by heating under vacuum to give an aqueous dispersion at 22.2% solids. Glass transition temperature was 79° C. as measured by DSC, and weight average molecular weight was 14,000.

Hydrophobic Particle P-3

The same preparation scheme as for P2 was used except that the relative amounts of components were adjusted such that the monomer feed ratio on a weight basis was 36.7% polycaprolactone polyol TONE0260, 3.9% dimethylol propionic acid, 10.7% 1,4-butanediol, 9.2% Bisphenol-A, and 39.5% isophorone diisocyanate. 2-Butanone and acetone were removed by heating under vacuum to give an aqueous dispersion at 22.32% solids. Glass transition temperature was 67.4° C. as measured by DSC, and weight average molecular weight was 16,200.

Hydrophobic Particle P-4

P4 is core-shell latex prepared by a sequential emulsion polymerization technique. The core polymer latex was polymerization first followed by the sequential feeding of the second monomer emulsions.

1700 g of water and 11.25 g of surfactant RHODACAL A-246L (Rhodia, Inc.) were charged to a 5L 3-neck flask equipped with a nitrogen inlet, mechanical stirrer and condenser. The flask was immersed in a constant temperature bath at 80° C. and purged with nitrogen for 20 min. 1.5 g of sodium persulfate was added and followed by the addition of first monomer emulsion. The first monomer emulsion was prepared from the mixture of 100 g of water, 3.75 g of A-246L, 294.0 g of butyl methacrylate, 12 g of sodium 2-sulfo-1,1-dimethylethyl acrylamide (50% active solution) and 1.5 g of sodium persulfate. The mixture was agitated at all time during the feeding of monomer emulsion. The addition time of the monomer emulsion was two hours. The polymerization was continued for additional 70 min after the addition of the monomer emulsion, then cool to room temperature to produce the core latex at 10.3% solids.

200 g of the core latex described above, 0.89 g of surfactant DOWFAX 2A1 (Dow Chemical Co.), and 2.4 g of 50% sodium 2-sulfo- 1,1- dimethylethyl acrylamide solution were charged to a 1L 3-neck flask equipped with a nitrogen inlet, mechanical stirrer and condenser. The flask was immersed in a constant temperature bath at 40° C. and purged with nitrogen for 20 min. 6.0 g of 10% sodium metabisulfite solution was added and followed by the addition of monomer mixture over a period of two hours. The monomer mixture consisted of 6 g of ethyl acrylate and 52.8 g of vinylidene. The polymerization was continued for additional 16 hours at 40° C. after the addition of the monomers, then cooled to room temperature and filtered to produce a core-shell latex at 29.2% solids and 76 nm in average particle size.

Hydrophobic Particle P-5 (Ethyl Acrylate/Vinylidene Chloride/Hydroxyethyl Methacrylate Latex) (10/88/2)

To a 20-ounce polyethylene bottle was added 341 grams of demineralized water. The water was purged for 15–20 minutes with nitrogen. The following were added to the reactor in order: 5.10 grams of 30% Triton® surfactant, 770, 3.06 grams of hydroxyethyl methacrylate, 15.29 grams of ethyl acrylate, 134.59 grams of vinylidene chloride, 0.7586 grams of potassium metabisulfite, and 0.3794 grams of potassium persulfate. The bottle was capped and placed in a tumbler bath at 40° C., and held there for 16–20 hours. The product was then removed from the bath, and cooled to 20° C. The product was filtered through cheesecloth. Glass transition temperature was 10° C. as measured by DSC, average particle size obtained from PCS was 83 nm.

Hydrophobic Particle P-6 (Ethyl Acrylate/Vinylidene Chloride/Methacrylic Acid) Latex (10/88/2)

This latex was prepared similar to P-5, except replacing hydroxyethyl methacrylate with methacrylic acid, and the surfactant used was A-246L instead of Triton®770. Glass transition temperature was 8° C. as measured by DSC, average particle size obtained from PCS was 71 nm.

Additional Materials (1) Airvol® 203 poly(vinyl alcohol) (PVA) was obtained from Air Products which was 87 to 89% hydrolyzed (by hydrolyzed is meant that the acetate groups in the monomeric units are converted to hydroxy groups) and had a number-average molecular weight of 12,000 and a weight-average molecular weight of 35,000.

(2) All block copolymers of ethylene oxide and propylene oxide employed in this invention were obtained from BASF. Their properties are summarized in Table 1 as follows:

TABLE 1

| Product | Structure | Weight % of Polyethylene Oxide | Molecular Weight of Polypropylene Oxide | Average Molecular weight |
|---|---|---|---|---|
| Pluronic ® F-127 | EO PO EO | 70% | 3600 | 12600 |
| Pluronic ® F-88 | EO PO EO | 80% | 2400 | 11400 |
| Pluronic ® F-87 | EO PO EO | 70% | 2400 | 7700 |

TABLE 1-continued

| Product | Structure | Weight % of Polyethylene Oxide | Molecular Weight of Polypropylene Oxide | Average Molecular weight |
|---|---|---|---|---|
| Pluronic ® F-38 | EO PO EO | 80% | 900 | 4700 |
| Pluronic ® F-77 | EO PO EO | 70% | 2100 | 6600 |
| Pluronic ® P-85 | EO PO EO | 50% | 2400 | 4600 |
| Pluronic ® P-105 | EO PO EO | 50% | 3000 | 6500 |
| Tetronic ® 1307 | EO PO PO EO<br>EO PO PO EO | 70% | 3900 | 18000 |
| Tetronic ® 908 | EO PO PO EO<br>EO PO PO EO | 80% | 2700 | 25000 |
| Tetronic ® 1107 | EO PO PO EO<br>EO PO PO EO | 70% | 3300 | 15000 |

(3) Poly(ethylene oxide) of molecular weight 18,500 was purchased from PolyScience (Cat. #04686).

Preparation of Color Photographic Paper 1

Samples was prepared by coating in sequence blue-light sensitive layer, interlayer, green-light sensitive layer, UV layer, red-light sensitive layer, UV layer and overcoat on photographic paper support. The components in each individual layer are described below.

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-1, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.31 $\mu$m in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edge length size. The emulsion is optimally sensitized by the addition of glutaryldiaminophenyldisulfide, sodium thiosulfate, tripotassium bis{2-[3-(2-sulfobenzamido) phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Light Sensitive Layer | |
| | Gelatin | 90.13 |
| | Blue sensitive silver (Blue EM-1) | 19.80 |
| | Y-1 | 38.50 |
| | ST-1 | 7.40 |
| | ST-2 | 7.40 |
| | ST-3 | 7.40 |
| | Tributyl Citrate | 7.40 |
| | 5-chloro-2-methyl-4-isothiazolin-3-one/2-methyl-4-isothiazolin-3-one(3/1) | 0.013 |
| | 2-Cyclopenten-1-one, 2,5-dihydroxy-5-methyl-3-(4-morpholinyl)- | 0.60 |
| | Benzenesulfonic acid, 2,5-dihydroxy-4-(1-methylheptadecyl)-, monopotassium salt | 0.44 |
| | 5H-Tetrazole-5-thione, 1,2-dihydro-1-phenyl- | 0.012 |
| | Dye-1 | 1.375 |
| Layer 2 | Y/M Interlayer | |
| | Gelatin | 70.00 |
| | 1,4-Benzenediol, 2,5-bis(1,1,3,3-tetramethylbutyl)- | 10.00 |
| | Phosphoric acid, tris(methylphenyl) ester | 15.00 |
| | Benzenepropanoic acid, 3,5-bis(1,1-dimethylethyl)-4-hydroxy-, octadecyl ester | 1.50 |
| | Catechol disulfonate | 4.60 |
| Layer 3 | Green Light Sensitive Layer | |
| | Gelatin | 114.95 |
| | Green sensitive silver (Green EM-1) | 10.70 |
| | M-1 | 17.00 |
| | Oleyl Alcohol | 20.26 |
| | Diundecyl phthalate | 10.43 |
| | ST-3 | 5.51 |
| | ST-4 | 11.01 |
| | Dye-2 | 0.952 |

-continued

| Layer | Item | Laydown (mg/ft$^2$) |
|---|---|---|
| Layer 4 | M/C Interlayer | |
| | Gelatin | 70.00 |
| | 1,4-Benzenediol, 2,5-bis(1,1,3,3-tetramethylbutyl)- | 10.00 |
| | Phosphoric acid, tris(methylphenyl) ester | 15.00 |
| | Benzenepropanoic acid, 3,5-bis(1,1-dimethylethyl)-4-hydroxy-, octadecyl ester | 1.50 |
| | Catechol disulfonate | 3.30 |
| | Copolymer of acrylamide and 2-Sulfo-1,1-dimethylethyl acrylamide, sodium salt at 20/80 weight ratio | 5.09 |
| Layer 5 | Red Light Sensitive Layer | |
| | Gelatin | 117.80 |
| | Red Sensitive silver (Red EM-1) | 17.20 |
| | C-1 | 22.80 |
| | Dibutyl Sebacate | 38.48 |
| | Tris(2-ethylhexyl)phosphate | 12.83 |
| | UV-1 | 31.35 |
| | Dye-3 | 0.71 |
| Layer 6 | UV Overcoat | |
| | Gelatin | 49.00 |
| | UV-1 | 12.07 |
| | UV-2 | 2.13 |
| | 1,4-Benzenediol, 2,5-bis(1,1,3,3 tetramethylbutyl)- | 5.46 |
| | Tris(2-ethylhexyl)phosphate | 4.73 |
| | Nitric acid | 0.44 |
| | 2-Naphthalenesulfonic acid, tris(1-methylethyl)-, sodium salt | 8.00 |
| Layer 7 | SOC | |
| | Gelatin | 60.0 |
| | Bis-vinylsulfonylmethane | 11.00 |
| | SF-1 | 1.00 |
| | SF-2 | 2.00 |

BSD-1

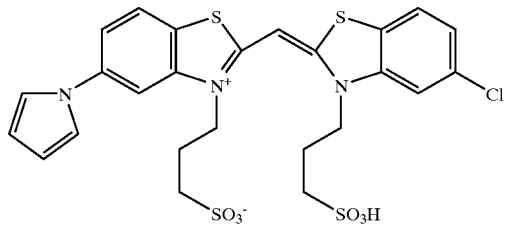

GSD-1

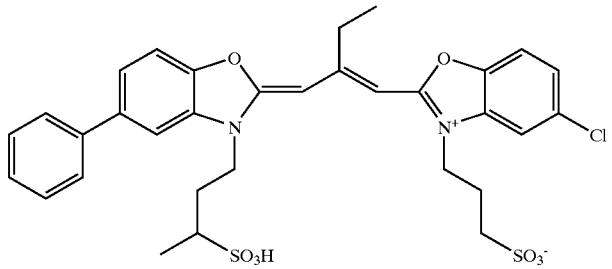

-continued
RSD-1
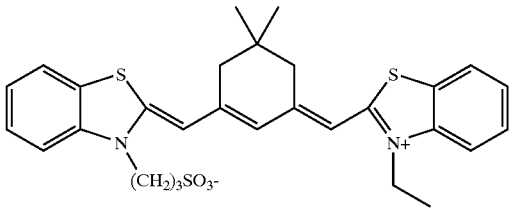
Y-1
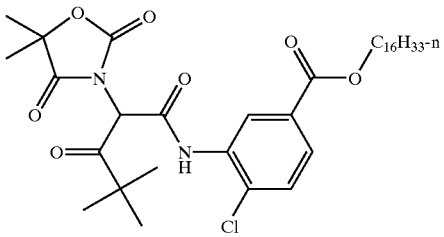
M-1
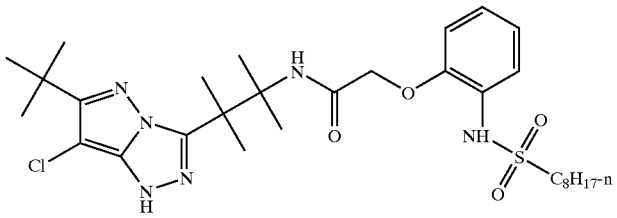
C-1
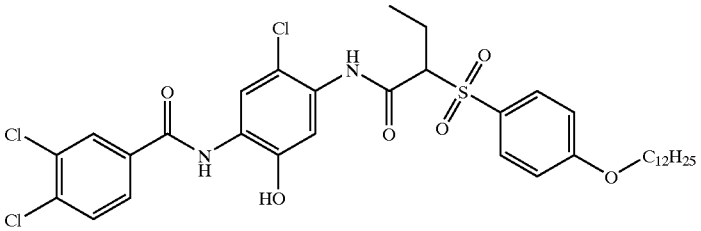
Dye-1
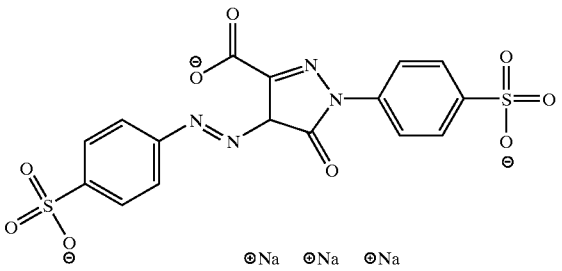

-continued
Dye-2
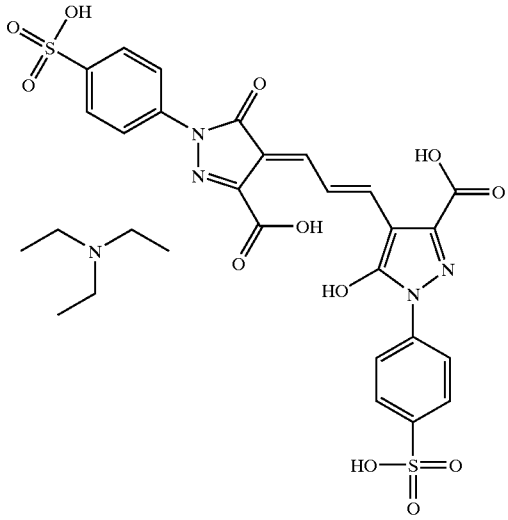
Dye-3
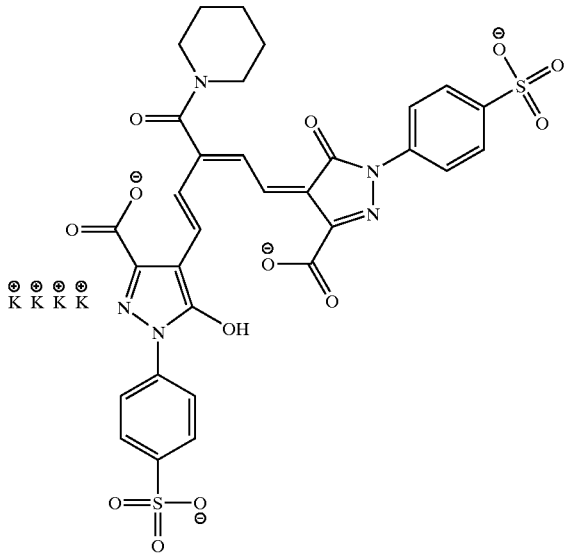
ST-1
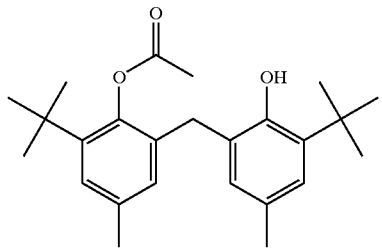
ST-2
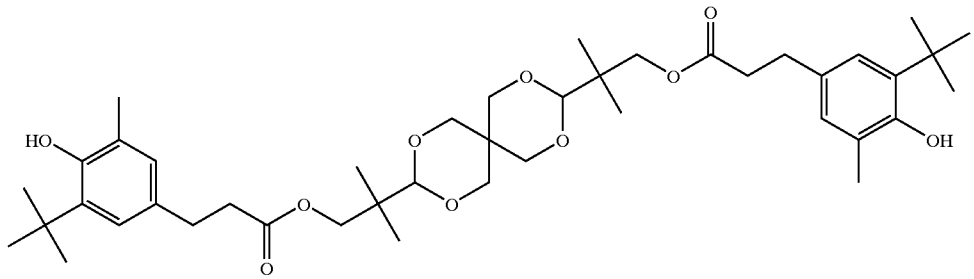

-continued
ST-3
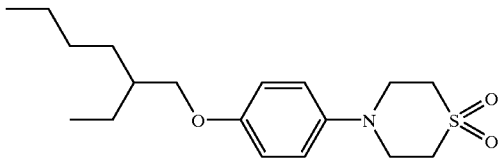
ST-4
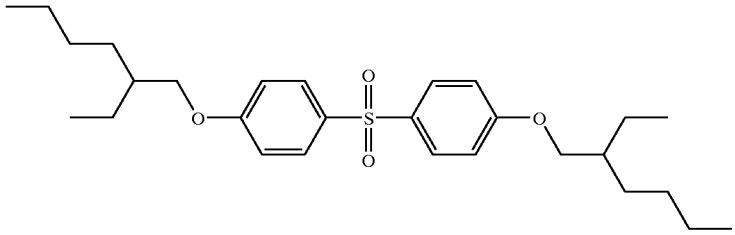
UV-1
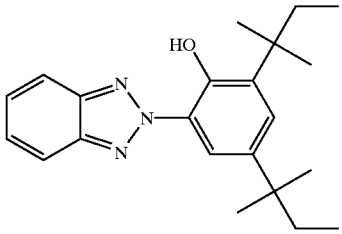
UV-2
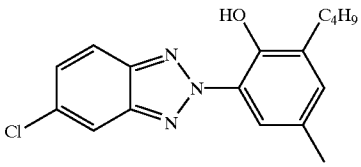
SF-1
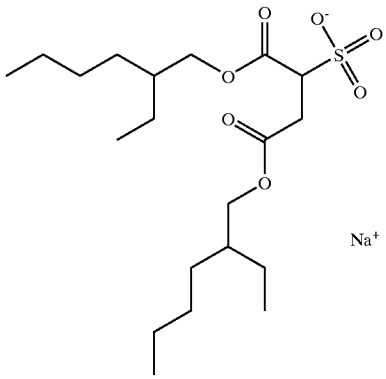
SF-2
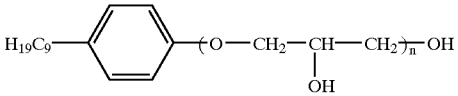

Standard RA-4 process steps and conditions:

| Solution/Step | Time (seconds) | Temperature (° F.) |
|---|---|---|
| (1) Prime SP Developer | 45 | 100 |
| (2) Prime Bleach-Fix | 45 | 86–97 |
| (3) Prime Stabiliser | 90 | 86–99 |
| (4) Drying | As needed | Generally at least 140; not to exceed 205 |

Testing Photographic Samples

Optical Density of an Image in the Unexposed Area

Samples, not being exposed to light., were treated with standard RA-4 process, and dried. Status A reflectance density in blue channel (Dmin(B)) was read by an X-RITE Model 820 densitometer and reported.

Test for Water Resistance:

Aqueous solutions of Ponceau Red dye are known to stain gelatin through ionic interaction and therefore are used to test water resistance of the overcoats. Ponceau Red dye solution was prepared by dissolving 1 gram of dye in 1000 grams mixture of acetic acid and water (5 parts: 95 parts). Samples, without being exposed to light, were processed through the Kodak RA4 process to obtain white Dmin samples. The water resistance test was done by placing a drop of the dye solution on the sample for 10 minutes followed by a 30-second water rinse to removed excess dye solution on the coating surface. Each sample was then air dried, and status A reflectance density on the spotted area was recorded. Assuming that the optical density of a Dmin check image with no protective overcoat corresponds to 0% water resistance and that an optical density of 0 corresponds to 100% water resistance, the percent water resistance for a sample is calculated using the following equation.

Percent water resistance=100 [1−(status A density of sample/status A density of control coating)]

Test of Wet Abrasion Resistance:

As a means of determining the resistance of the inventive overcoat to damage caused by photographic processing equipment, the following test was conducted. Samples were processed by the conventional RA-4 process with the exception that, after 5 seconds of time in the developer tank, the front surface of the photographic paper was placed in contact with the knit-cloth material used to cover the transport rollers in a "socked-roller" processing machine such as those manufactured by Kreonite®. The assembly of fabric in contact with the overcoat was then fed through a set of pressure rollers in order to press the knit-cloth into the partially swollen overcoat. After this treatment, the remainder of the conventional process was completed, followed by heated air-drying. The resulting Dmax print image was then examined for, evidence of physical marring or embossing caused by contact with the cloth material, and ranked according to the following scale:

| Rating of Socked-roller Damage | Description |
|---|---|
| None | No visible evidence of any damage |
| Light | Occasional, small damage marks |

-continued

| Rating of Socked-roller Damage | Description |
|---|---|
| Moderate | Frequent, small damage marks |
| Heavy | Visible damage over entire area of contact |
| Severe | Complete embossing of the surface by the threads of the knit cloth |

Example 1

Color photographic paper samples of this invention were prepared similar to sample 1 described previously, except replacing the gelatin in overcoat layer (layer 7) with poly (vinyl alcohol) (PVA), polyurethane particles and PEO-b-PPO at the laydowns described in Table 2. Water resistance of these samples after photographic processing, their optical densities in the unexposed area and their wet abrasion propensity as determined by socked-roller test are also summarized in Table 2 as follows:

TABLE 2

| Example ID | Overcoat Composition (in mg/sq.ft.) | Type | % Water resistance after standard processing | Dmin (B) | Socked-roller Damage |
|---|---|---|---|---|---|
| 1 | 60 gelatin | Comparison | 0% | 0.05 | None |
| 2 | 50 PVA<br>160 P-1 | Comparison | 97% | 0.15 | Severe |
| 3 | 50 PVA<br>160 P-1<br>10 Pluronic ® F-127 | Invention | 97% | 0.06 | Light |
| 4 | 50 PVA<br>160 P-I<br>10 Tetronic ® 1307 | Invention | 98% | 0.09 | Light |
| 5 | 50 PVA<br>160 P-1<br>10 Tetronic ® 908 | Invention | 98% | 0.07 | Moderate |
| 6 | 50 PVA<br>160 P-1<br>10 Tetronic ® 1107 | Invention | 97% | 0.11 | Light |
| 7 | 50 PVA<br>160 P-2 | Comparison | 95% | 0.27 | Light |
| 8 | 40 PVA<br>160 P-2<br>10 Pluronic ® F-127 | Invention | 92% | 0.07 | Light |
| 9 | 50 PVA<br>160 P-3 | Comparison | 92% | 0.28 | Moderate |
| 10 | 50 PVA<br>160 P-3<br>10 Pluronic ® F-127 | Invention | 97% | 0.08 | Light |
| 11 | 50 PVA<br>160 P-3<br>10 Poly(ethlene oxide),<br>MW = 18500 | Comparison | 97% | 0.15 | Moderate |

Sample 1, using gelatin in the overcoat, did not possess water resistance, even though it showed the lowest Dmin(B) and best wet scratch resistance. Samples 2, 7 and 9, which used PVA and polyurethane particles in the overcoat, demonstrated water resistance with undesirably high Dmin(B) and socked-roller damage (marks). Samples 3 through 6 showed improved Dmin(B) and improved socked-roller-damage rating while maintaining water resistance property compared to sample 2 which did not have PEO-b-PPO in the overcoat. The same advantage was observed in sample 8 vs. sample 7, and sample 10 vs. sample 9. In addition, sample 11, which was prepared using poly(ethylene oxide), showed that it did not provide any improvement as PEO-b-PPO did in sample 10.

Example 2

Color photographic paper samples of this invention were prepared similar to sample 1 described previously, except replacing the gelatin in overcoat layer (layer 7) with poly (vinyl alcohol) (PVA), vinyl-acrylate particles and PEO-b-PPO at the laydowns described in Table 3. The samples were evaluated using the same methods as described previously.

TABLE 3

| Example ID | Overcoat Composition (in mg/sq.ft.) | Type | % Water resistance after standard processing | Dmin (B) | Socked-roller Damage |
|---|---|---|---|---|---|
| 1 | 60 gelatin | Comparison | 0% | 0.05 | None |
| 12 | 50 PVA<br>160 PA | Comparison | 17% | 0.07 | Heavy |
| 13 | 50 PVA<br>160 PA<br>10 Pluronic ® F-127 | Invention | 97% | 0.09 | None |
| 14 | 15 PVA<br>160 P-5 | Comparison | 70% | 0.06 | None |
| 15 | 40 PVA<br>160 P-5<br>10 Pluronic ® F-127 | Invention | 95% | 0.07 | None |
| 16 | 40 PVA<br>160 P-6 | Comparison | 9% | 0.04 | None |
| 17 | 40 PVA<br>160 P-6<br>10 Pluronic ® F-127 | Invention | 95% | 0.05 | None |
| 18 | 40 PVA<br>160 P-6<br>10 Pluronic ® F-88 | Invention | 94% | 0.05 | None |
| 19 | 40 PVA<br>160 P-6<br>10 Pluronic ® F-87 | Invention | 95% | 0.05 | None |
| 20 | 40 PVA<br>160 P-6<br>10 Pluronic ® F-38 | Invention | 75% | 0.05 | None |
| 21 | 40 PVA<br>160 P-6<br>10 Pluronic ® F-77 | Invention | 89% | 0.05 | None |
| 22 | 40 PVA<br>160 P-6<br>10 Pluronic ® F-85 | Invention | 92% | 0.05 | None |
| 23 | 40 PVA<br>160 P-6<br>10 Pluronic ® P-105 | Invention | 92% | 0.05 | None |
| 24 | 40 PVA<br>160 P-6<br>10 Tetronic ® 1307 | Invention | 97% | 0.06 | None |
| 25 | 40 PVA<br>160 P-6<br>10 Tetronic ® 908 | Invention | 97% | 0.06 | None |
| 26 | 40 PVA<br>160 P-6<br>10 Tetronic ® 1107 | Invention | 97% | 0.05 | None |

The data of Table 3 demonstrate that the water resistance afforded by incorporation of the water-dispersible particles, such as P-4, P-5 or P-6 is enhanced by the addition of PEO-b-PPO, while maintaining the low density and low socked-roller marking.

The invention has been described in detail with particular reference in preferred embodiments thereof, but it will be understood that variations and modifications can be effected within the spirit and scope of the invention.

What is claimed is:

1. A photographic element comprising:

(a) a support;

(b) at least one silver-halide emulsion layer superposed on a side of said support; and (c) overlying the silver-halide emulsion layer, a processing-solution-permeable protective overcoat having a laydown of at least 0.54 g/m$^2$ (50 mg/ft$^2$) made from a coating composition comprising the following:

a) 30 to 95%, by weight of solids, of water-dispersible polymer in the form of particles having an average particle size of less than 500 nm and a $T_g$ between −40° C. and 80° C., b) 4.5 to 69.5%, by weight of solids, of water-soluble polymer; and c) 0.50 to 20%, by weight of solids, of a compound comprising at least one block-copolymer chain of ethylene oxide and propylene oxide.

2. The photographic element of claim 1 wherein said water-dispersible polymer is selected from the group consisting of polyesters, polyamides, polyurethanes, polyureas, polyethers, polycarbonates, polyacid anhydrides and combinations of the foregoing; or polymers derived from vinyl ethers, vinyl heterocylic compounds, styrenes, olefins, halogenated olefins, unsaturated acids and esters thereof, unsaturated nitriles, vinyl alcohols, acrylamides and methacrylamides, and vinyl ketones, poly(epoxides), copolymers formed from combinations of the corresponding monomers, and combinations of the foregoing polymers.

3. The photographic element of claim 1 wherein said compound comprising a block-copolymer chain has a molecular weight of greater than 4,000, in which compound the oxyethylene portion is at least 40 weight percent of the total oxyethylene and oxypropylene in the compound.

4. The photographic element of claim 1 wherein said water-dispersible polymer has an acid number of less than or equal to 60.

5. The imaging photographic element of claim 1 wherein said water-soluble polymer is selected from the group consisting of polyvinyl alcohol, cellulose ethers, poly(N-vinyl amides), polyacrylamides, polyesters, poly(ethylene oxide), dextrans, starch, noncrosslinked gelatin, whey, albumin, poly(acrylic acid), poly(ethyl oxazolines), alginates, gums, poly(inethacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

6. The imaging photographic element of claim 1 wherein the weight average molecular weight of said water-soluble polymer is less than or equal to 300,000.

7. The photographic element of claim 1 wherein said water-dispersible polymer is a polyurethane.

8. The photographic element of claim 1 wherein said water-dispersible polymer is a vinyl polymer comprising 20%–80% by weight of monomer represented by the following structure:

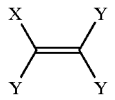

wherein: X is selected from the group consisting of —Cl, —F, or —CN, and Y is each independently selected from the group consisting of H, Cl, F, CN, $CF_3$, $CH_3$, $C_2H_5$, n-$C_3H_7$, iso-$C_3H_7$, n-$C_4H_9$, n-$C_5H_{11}$, n-$C_6H_{13}$, $OCH_3$, $OC_2H_5$, phenyl, $C_6F_5$, $C_6Cl_5$, $CH_2Cl$, $CH_2F$, Cl, F, CN, $CF_3$, $C_2F_5$, n-$C_3F_7$, iso-$C_3F_7$, $OCF_3$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

9. The photographic element of claim 1 wherein the support comprises polymeric films, papers or glass.

10. The photographic element of claim 1 wherein the overcoat composition further comprises UV absorbers, surfactants, emulsifiers, coating aids, lubricants, matte particles, rheology modifiers, crosslinking agents, antifoggants, inorganic fillers, pigments, magnetic particles and/or biocides.

11. The photographic element of claim 1 wherein said compound comprises primarily, by weight, one to four block-copolymer chains and a total molecular weight of between 4,000 and 100,000, in which compound the oxyethylene portion of the total oxyethylene and oxypropylene units in the compound is 60 to 90 weight percent.

12. A method of making a photographic print comprising:

(a) providing a photographic element comprising a support, a silver-halide emulsion layer superposed on a side of said support, a processing-solution-permeable coating overlying the silver-halide emulsion layer, said overcoat having a laydown of at least 0.54 g/m$^2$ (50 mg/ft$^2$) made from a coating composition comprising 30 to 95%, by weight of solids, of water-dispersible polymer in the form of particles having an average particle size of less than 500 nm and a $T_g$ between −40° C. and 80° C., and 4.5 to 69.5% by weight of solids, of water-soluble polymer such that more than 30 weight percent of the water-soluble polymer is washed out during photographic processing wherein the weight ratio of water-dispersible polymer to water-soluble polymer is between 50:50 to 90:10, further in combination with a compound that comprises at least one poly(oxyethylene)-poly(oxypropylene) block-copolymer chain, and;

(b) imagewise exposing the photographic element to light;

(c) developing the photographic element in a developer solution having a pH greater than 7 to obtain the photographic print; and (d) drying the photographic element to a temperature under 80° C. to render the overcoat water-resistant in the final product.

13. The method of claim 12 wherein said water-dispersible polymer comprises a polymer selected from the group consisting of polyesters, polyamides, polyurethanes, polyureas, polyethers, polycarbonates, polyacid anhydrides, combinations of the foregoing, polymers derived from vinyl ethers, vinyl heterocylic compounds, styrenes, olefins, halogenated olefins, unsaturated acids and esters thereof, unsaturated nitriles, vinyl alcohols, acrylamides and methacrylamides, and vinyl ketones, poly(epoxides) and copolymers thereof, and combinations of the foregoing.

14. The method of claim 12 wherein said water-dispersible polymer has an acid number of less than or equal to 60.

15. The method of claim 12 wherein said water-soluble polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly(methacrylic acid), poly(oxymethylene), poly(ethyleneimine), poly(ethylene glycol methacrylate), poly(hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

16. The method of claim 15 wherein the weight average molecular weight of said water-soluble polymer is less than 300,000.

17. The method of claim 12 wherein said compound comprising a block-copolymer chain has a molecular weight of between 4,000 and 100,000, in which compound the oxyethylene portion is 60 to 90 weight percent of the total amount of oxyethylene and oxypropylene units in the compound.

18. The method of claim 12 wherein the water-dispersible polymer is a polyurethane.

19. The method of claim 12 wherein said water-dispersible polymer is a vinyl polymer comprising 20%–80% by weight of monomer represented by the following structure:

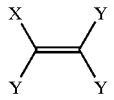

wherein: X is selected from the group consisting of —Cl, —F, or —CN, and Y is each independently selected from the group consisting of H, Cl, F, CN, $CF_3$, $CH_3$, $C_2H_5$, n-$C_3H_7$, iso-$C_3H_7$, n-$C_4H_9$, n-$C_5H_{11}$, n-$C_6H_{13}$, $OCH_3$, $OC_2H_5$, phenyl, $C_6F_5$, $C_6Cl_5$, $CH_2Cl$, $CH_2F$, Cl, F, CN, $CF_3$, $C_2F_5$, n-$C_3F_7$, iso-$C_3F_7$, $OCF_3$, $OC_2F_5$, $OC_3F_7$, $C(CF_3)_3$, $CH_2(CF_3)$, $CH(CF_3)_2$, —$COCF_3$, $COC_2F_5$, $COCH_3$, $COC_2H_5$.

20. The method of claim 1 wherein formation of the protective water-resistant overcoat occurs in the absence of fusing.

* * * * *